United States Patent [19]

Takeda

[11] Patent Number: 4,766,619

[45] Date of Patent: Aug. 30, 1988

[54] SANITARY DEVICE

[75] Inventor: Hisanobu Takeda, Aichi, Japan

[73] Assignee: Aisin Seiki Kabushiki Kaisha, Kariya, Japan

[21] Appl. No.: 79,972

[22] Filed: Jul. 31, 1987

[30] Foreign Application Priority Data

| | | | |
|---|---|---|---|
| Jul. 31, 1986 | [JP] | Japan | 61-181667 |
| Jul. 31, 1986 | [JP] | Japan | 61-181668 |
| Jul. 31, 1986 | [JP] | Japan | 61-181669 |
| Aug. 9, 1986 | [JP] | Japan | 61-187164 |

[51] Int. Cl.[4] ..... A47K 13/10

[52] U.S. Cl. ..... 4/251; 4/248

[58] Field of Search ..... 4/238, 248, 250, 251, 4/253, 661

[56] References Cited

U.S. PATENT DOCUMENTS

| | | | |
|---|---|---|---|
| 3,781,924 | 1/1974 | Davis | 4/251 |
| 4,491,989 | 1/1985 | McGrail | 4/251 |
| 4,551,866 | 11/1985 | Hibbs | 4/248 X |

*Primary Examiner*—Donald Watkins

*Attorney, Agent, or Firm*—Sughrue, Mion, Zinn, Macpeak, and Seas

[57] ABSTRACT

A shock-absorber is provided at a rear end portion of a toilet bowl is brought into operative engagement with a seat when inclination of the seat relative to an upper side of the toilet bowl becomes less than a set value. Thus, lowering or downward movement of the seat may be performed more quickly during the initial portion of the lowering movement prior to engagement with the shock absorber.

10 Claims, 9 Drawing Sheets

FIG. 11
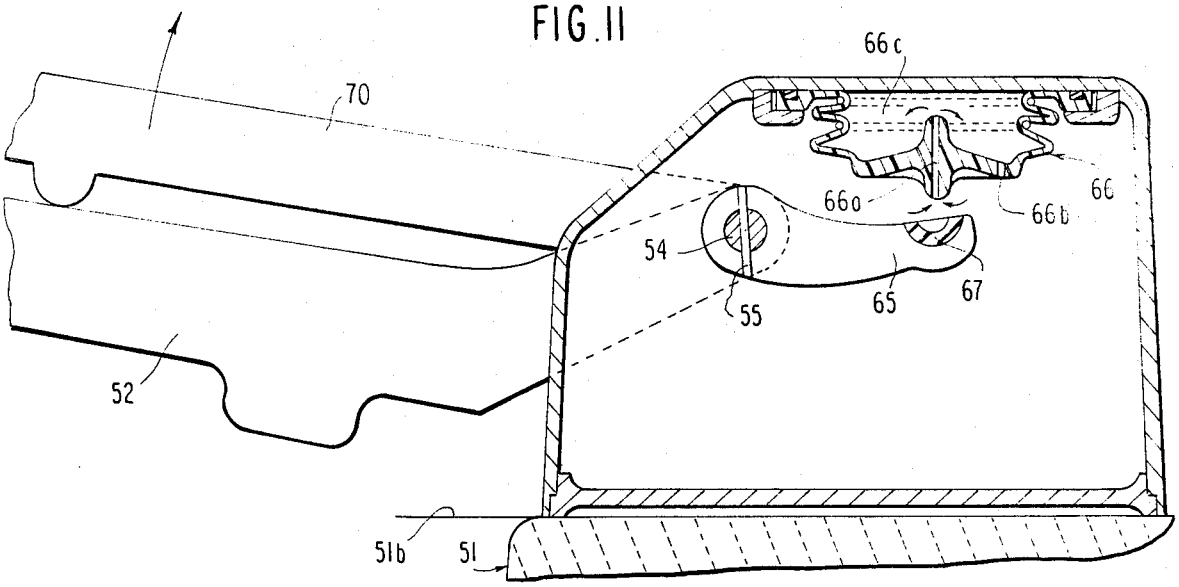
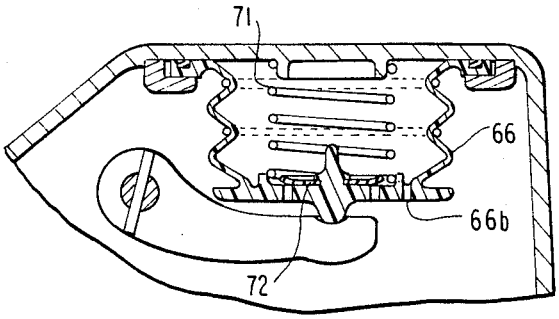
FIG. 12
FIG. 13
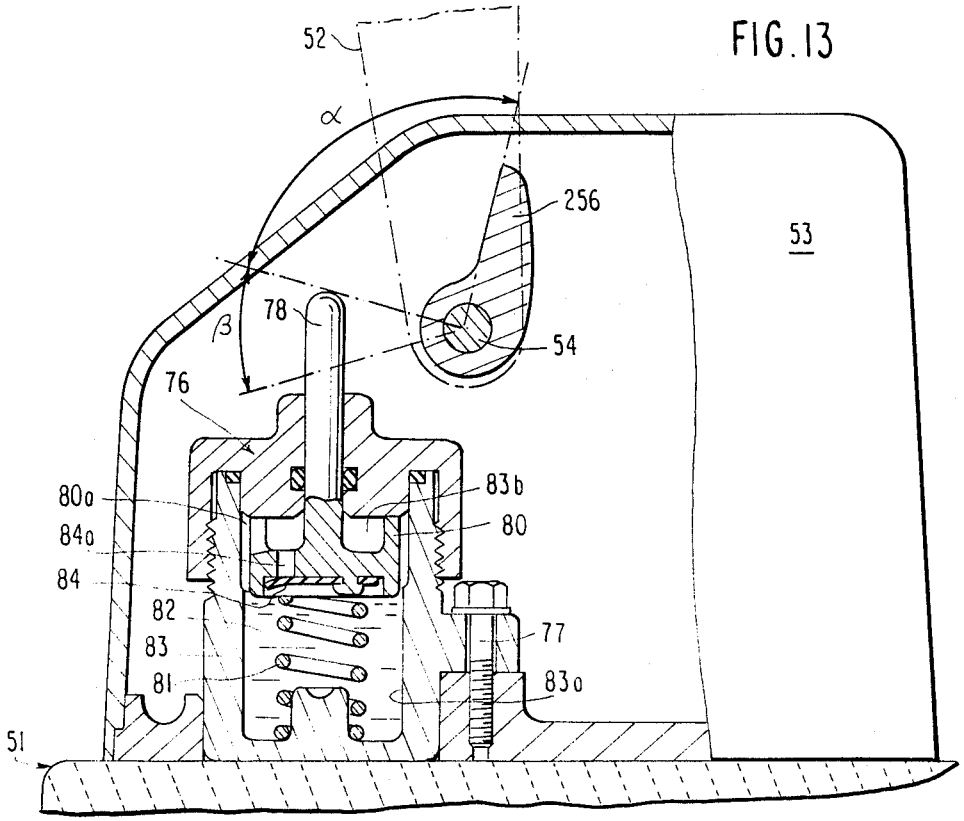

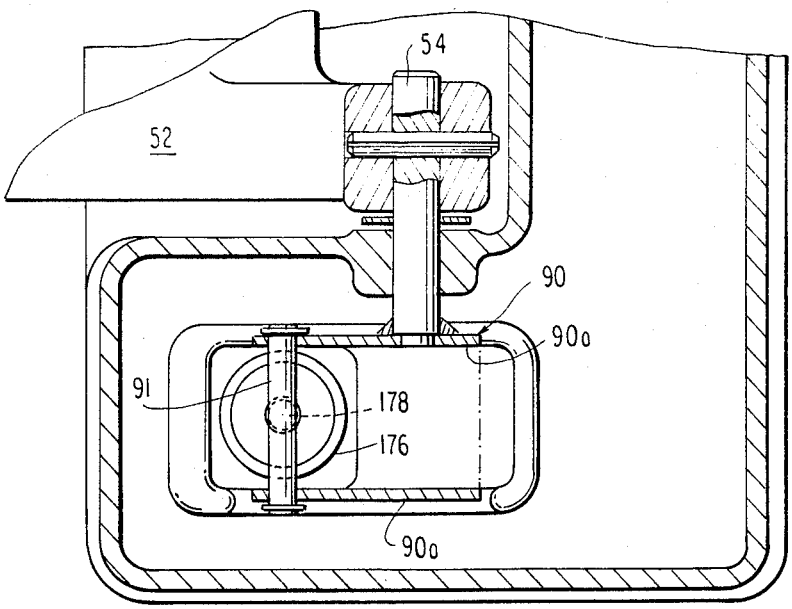
FIG. 17
FIG. 18
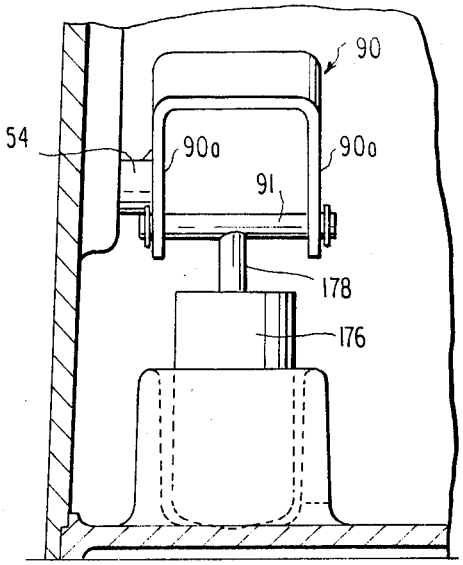

SANITARY DEVICE

BACKGROUND OF THE INVENTION

1. Field of the Invention

The present invention relates to a sanitary device and in particular to a toilet seat including a shock-absorber for preventing hard impact between the seat and the upper side of a toilet bowl.

2. Prior Art

A conventional shock-absorber in a sanitary device disclosed in U.S. Pat. No. 3,781,924 is in the form of dash-pot and upon flushing, is brought into operative engagement with a seat which is at a rest position thereof. After the engagement, lowering or downward movement of the seat may be performed without slamming due to the gravity restraining function of the dash-pot. However, due to continual operative connection between the shock-absorber and the seat, lowering movement of the seat from the rest position to the use position is subject to slow motion.

SUMMARY OF THE INVENTION

The main object of the present invention is to provide a sanitary device without the aforementioned drawback. A sanitary device according to the present invention is characterized in that a shock-absorber is brought into operative engagement with a seat when the inclination of the seat relative to the upper side of a toilet bowl becomes less than a set value. Thus, the seat is not decelerated from the beginning of downward movement to the engagement between the seat and the shock-absorber. This means that less deceleration is applied to the seat in comparison with the prior art. The less deceleration applied to the seat, the less time is required for downward movement thereof. Consequently, time required for downward movement of the seat is less than that of a conventional seat.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 11 is a view similar to FIG. 10 showing the seat in the partially raised position;

FIG. 12 is a cross-sectional view of a fourth embodiment of the present invention;

FIG. 13 is a cross-sectional view of a rear portion of a sanitary device according to a fifth embodiment of the present invention;

FIG. 17 is a plan view of the device in FIG. 16; and

FIG. 18 is an end view illustrating the relation between the seat and the oil-damper in FIG. 16.

DETAILED DESCRIPTION OF THE PREFERRED EMBODIMENTS

Figure 1:
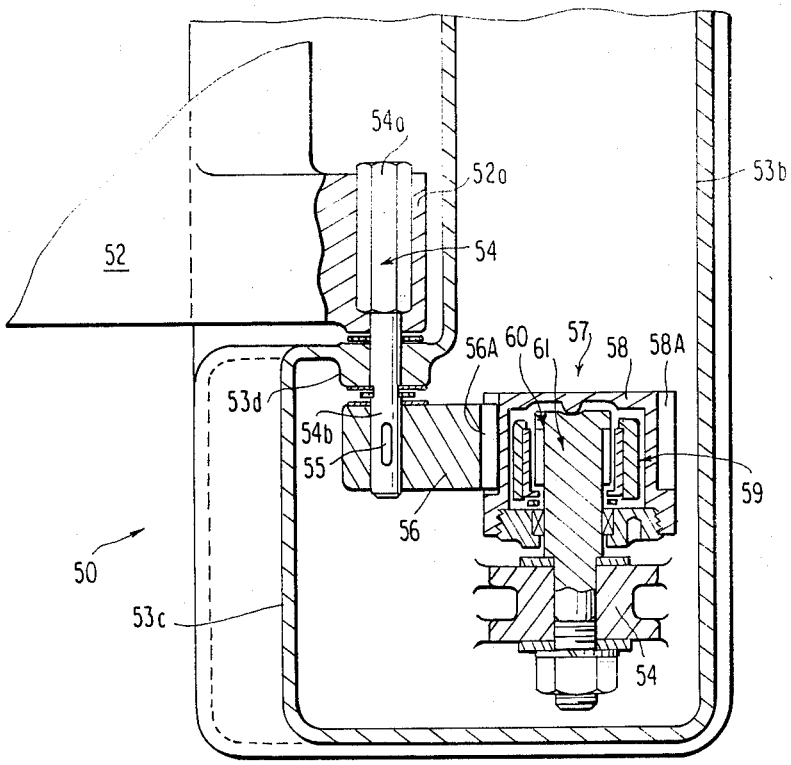
FIG. 1 is a plan view of the rear portion of a sanitary device according to a first embodiment of the present invention.

Referring now to FIGS. 1 through 4, a sanitary device 50 includes a toilet bowl 51. On the rear end portion 51*a* of the toilet bowl 51 there is installed a casing 53 having a base plate 53*a* and a cover member 53*b* detachably mounted thereto. The cover member 53*b* has a pair of forwardly projected portions 53*c*, 53*c* (only one is shown in FIG. 1). A pin 54 is rotatably supported on a side-wall 53*d* of the portion 53*c*. An inner end portion 54*a* of the pin 54 is fixed to a rear end projection 52*a* of a seat 52. Thus, the seat 52 is pivotably or hingedly connected to the rear end portion 51*a* of the toilet bowl 51 to be raised and covered. In the casing 53 a sector member 56 having on the outer periphery thereof a series of teeth 56A is clamped on an outer end portion 54*b* of the pin 54 by a cotter pin 55. Thus, the sector member 56 is movable together with the seat 52.

In the casing 53 a shock-absorber 57 is installed. The shock-absorber 57 serves for preventing a hard collision of the seat 52, which is being moved downwardly, with the upper side 51*b* of the toilet bowl 51. The shock-absorber 57 includes a stationary member 54 formed integrally with the base plate 53*a* and a shaft 61 connected to the stationary member 54. The shaft 61 is in parallel with the pin 54. On the shaft 61, a rotating member 58 is mounted via one-way clutch 60 which is of well-known configuration. Between the rotating member 58 and an outer body 60*c* of the one-way clutch 60, an annular clearance 59 is defined. The rotating member 58 is provided at an outer periphery thereof with a series of teeth 58A which are engageable with the teeth 56A of the sector member 56. The clearance 59 is filled with viscous fluid so as to generate a shearing force or mechanical friction between the outer body 60*c* of the one-way clutch 60 and the rotating member 58 upon rotation thereof.

Figure 2:
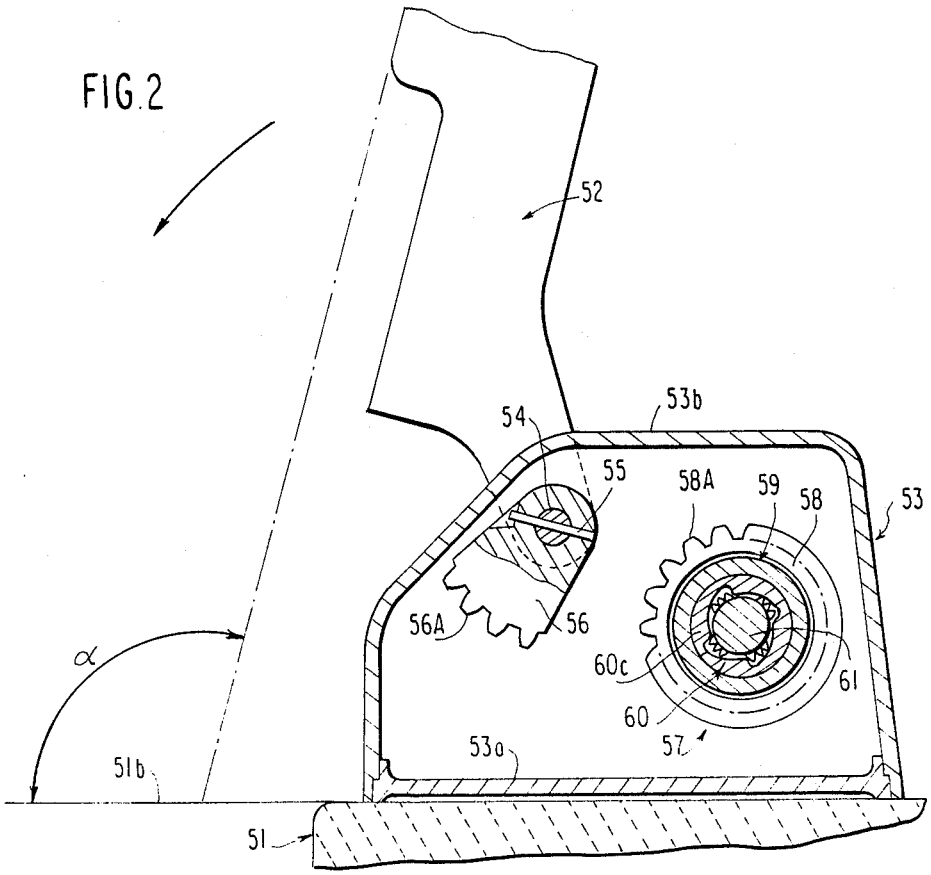
FIG. 2 is a side elevation view, partly in section, of the device shown in FIG. 1 with the seat in the fully raised position.
Figure 3:
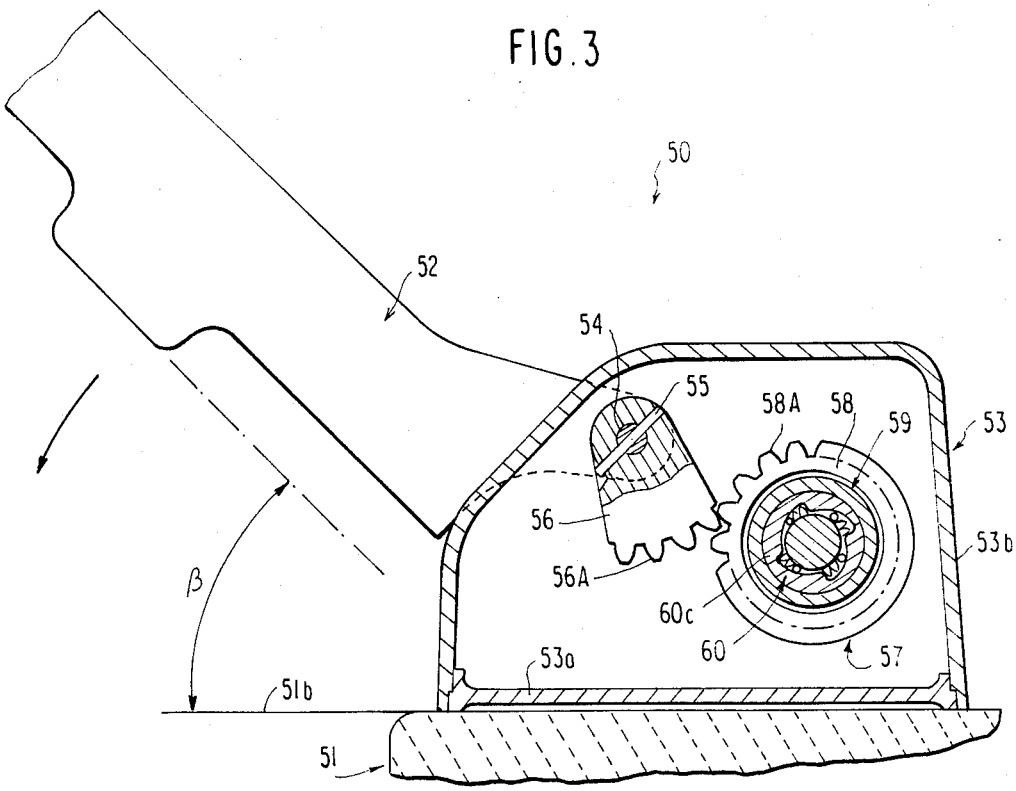
FIG. 3 is a side elevation view similar to FIG. 2 with the seat contacting the shock absorber in a partially covered position.
Figure 4:
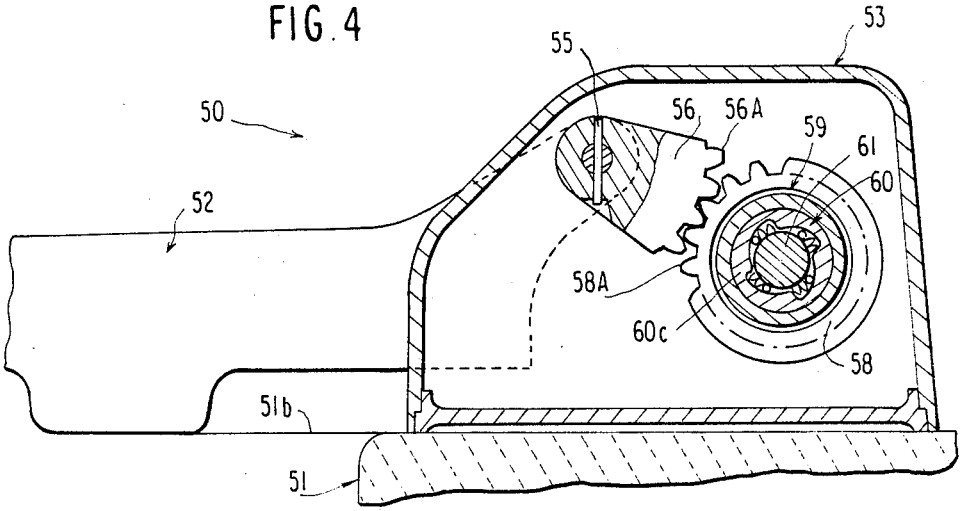
FIG. 4 is a side elevation view similar to FIG. 2 with the seat in the fully lowered position.
Figure 5:
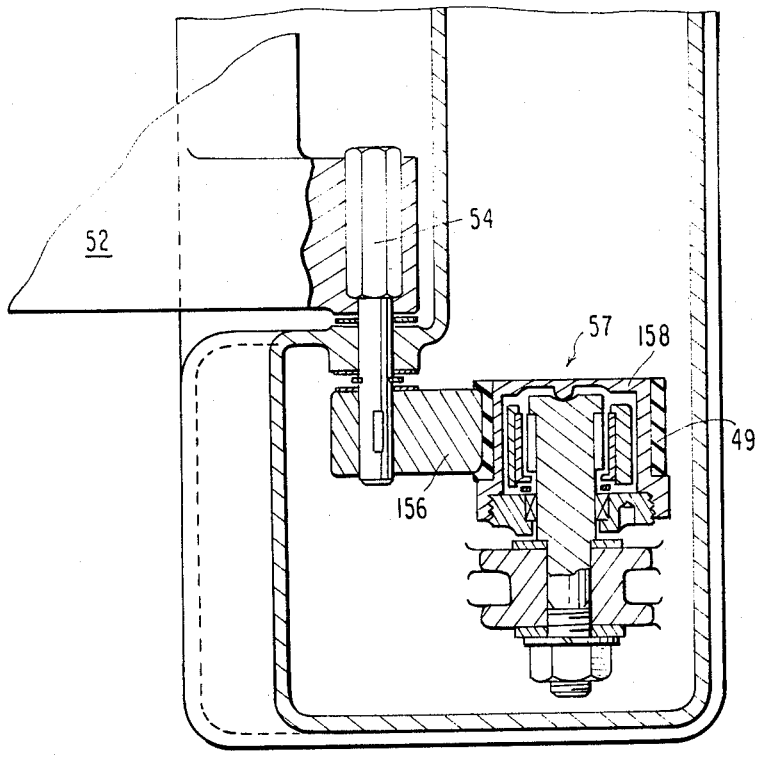
FIG. 5 is a plan view of a rear portion of a sanitary device according to a second embodiment of the present invention.
Figure 6:
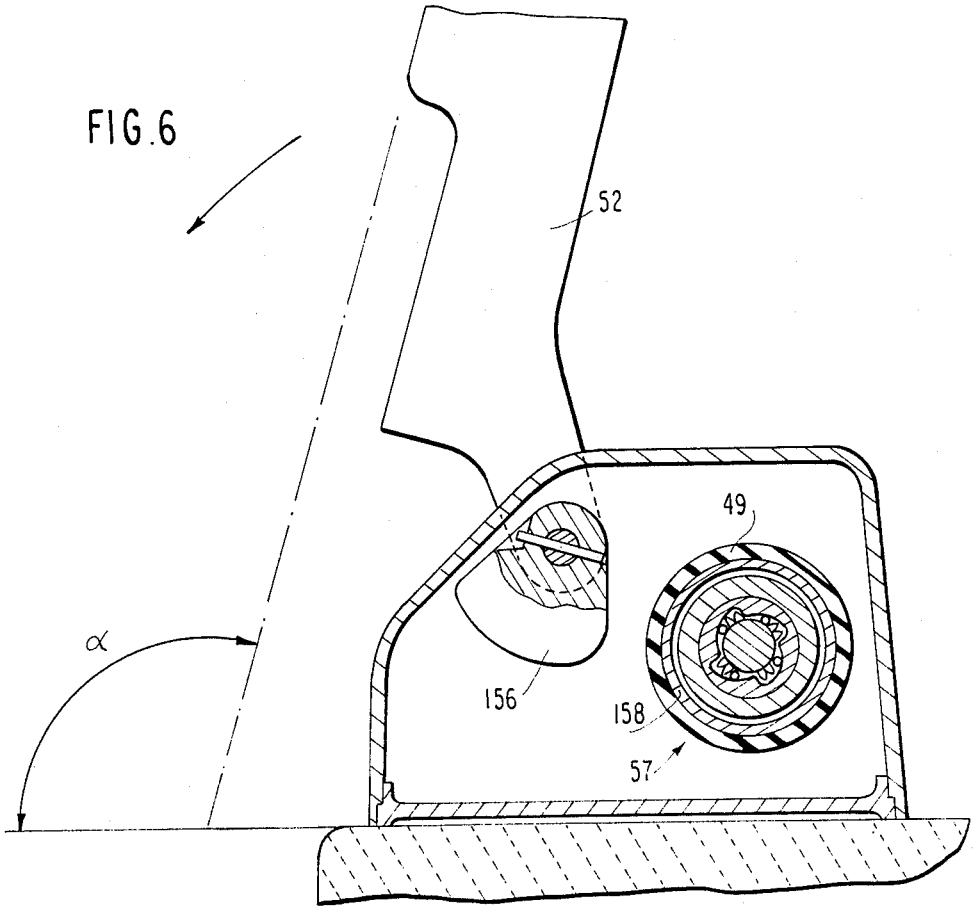
FIG. 6 is a side elevation view, partly in section, of the device shown in FIG. 5 with the seat in the fully raised position.
Figure 7:
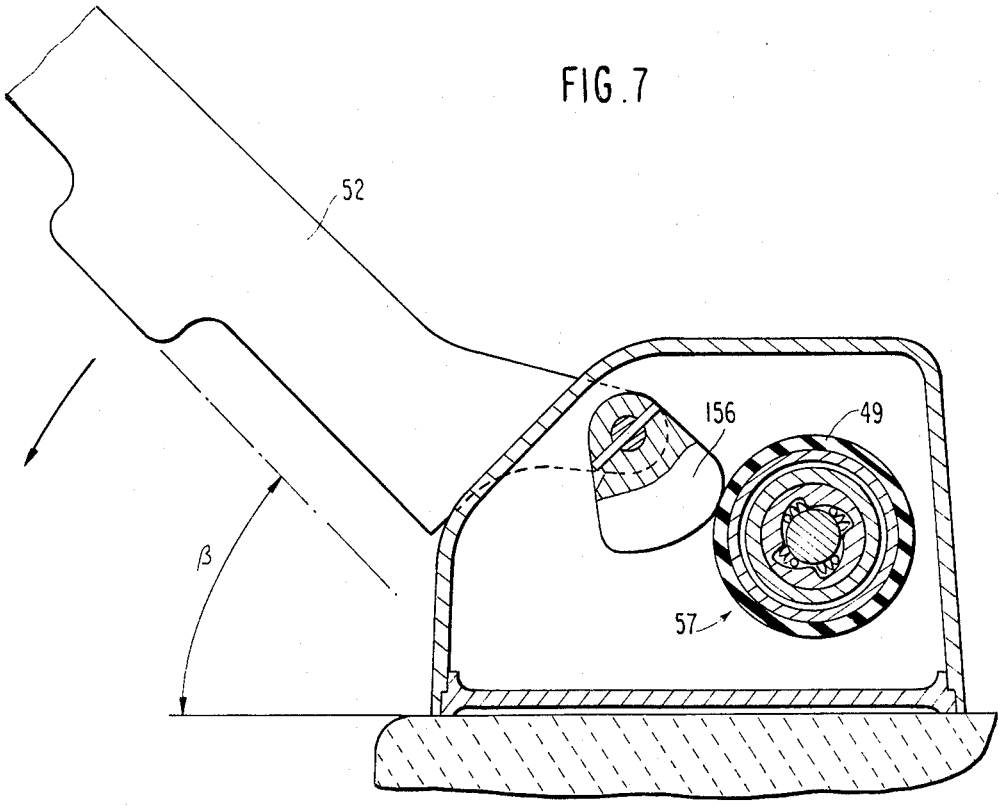
FIG. 7 is a side elevation view similar to FIG. 6 with the seat contacting the shock absorber in a partially covered position.
Figure 8:
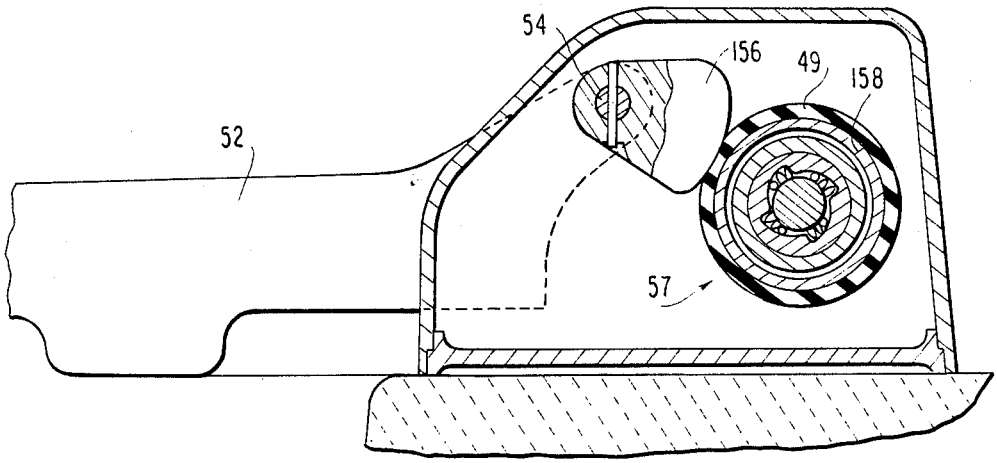
FIG. 8 is a side elevation view similar to FIG. 6 with the seat in the fully lowered position.

When the seat 52 is out of use and pivoted into fully raised position as shown in FIG. 2, the shock-absorber 57 is isolated from the sector member 56. Under this condition, the angle of inclination of the seat 52 relative to the upper side 51*b* of the toilet bowl 51 is indicated by angle $\alpha$. When the inclination of the seat 52 relative to the upper side 51*b* of the toilet bowl 51 reaches a set value indicated by angle $\beta$ during downward or lowering movement of the seat 52, as apparent from FIG. 3, the sector member 56 is brought into meshing engagement with the rotating member 58. The rotating member 58 is then rotated in the clockwise direction. The outer body 60c of the one-way clutch is prevented from rotation in the clockwise direction so that rotation of the sector member 56 is decelerated due to shearing force between the rotating member 58 and the stationary outer body 60c of the one-way clutch 60. Thus, the seat 52 is brought into rest on the upper side 51b is brought into rest on the upper side 51b of the toilet bowl 51 without a hard collision. During downward rotation from the angle $\alpha$ to the angle $\beta$ of the seat 52, the seat 52 is movable without deceleration or resistance. When the seat 52 is raised again, raising movement of the seat 52 is performed in a smooth manner because the one-way clutch 60 is out of operation.

Instead of the sector member 56 with the teeth 56A and a rotating member 58 with the teeth 58A, a sector member 156 having an arcuate outer surface and a rotating member 158 around which a resilient member 49 is mounted, are used as shown in the second embodiment of FIGS. 5 through 8. In such a construction, the sector member 156 is in frictional engagement with the resilient member 49 on the rotating member 158. The operation of this embodiment is the same as the first embodiment.

Figure 9:
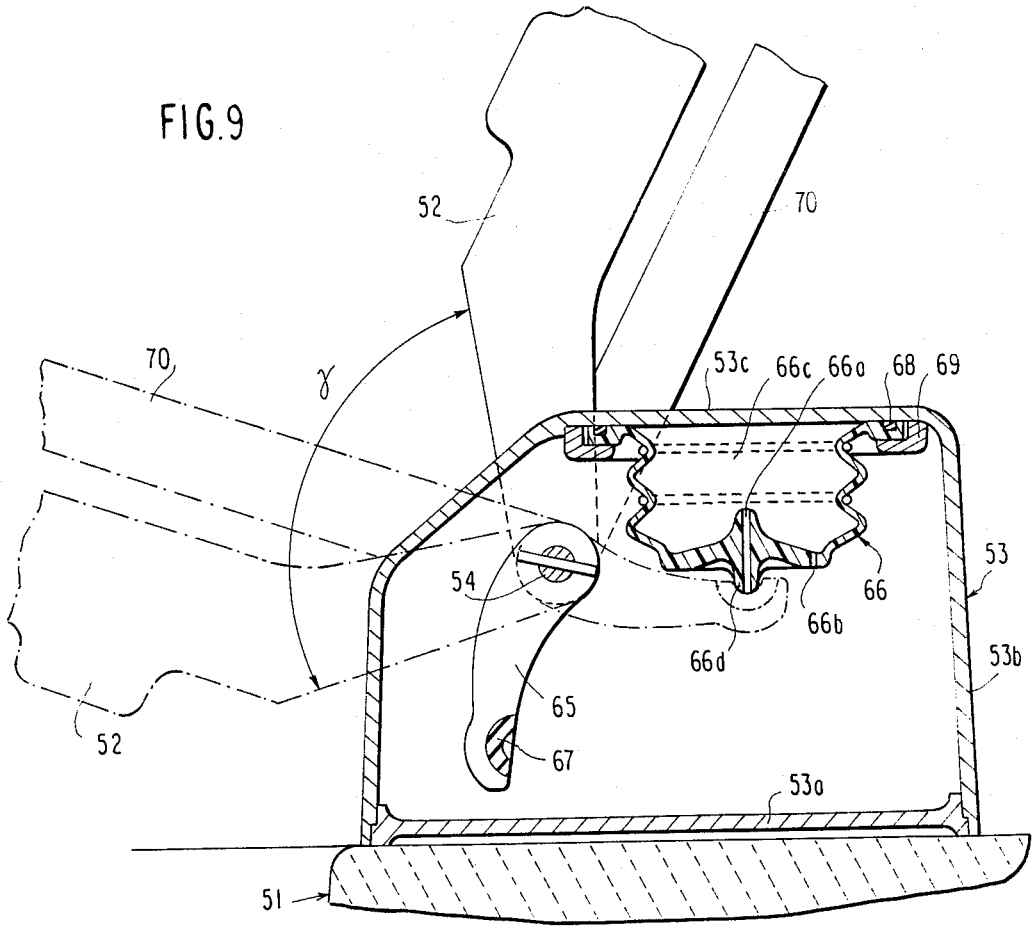
FIG. 9 is a cross-sectional view of a rear portion of a sanitary device according to a third embodiment of the present invention.
Figure 10:
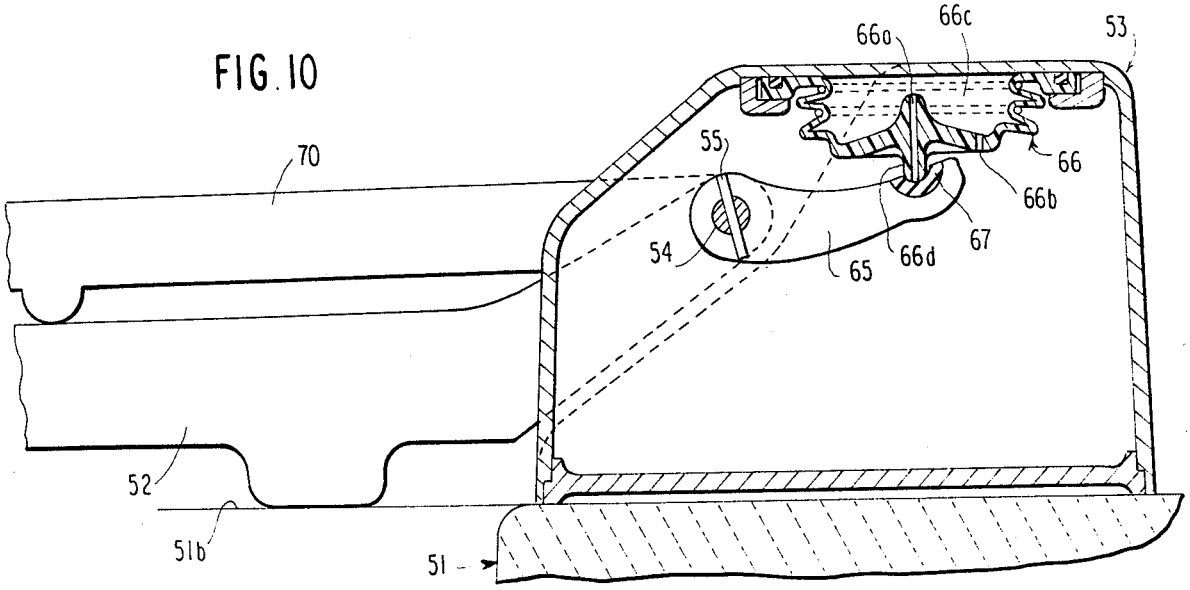
FIG. 10 is a view similar to FIG. 7 illustrating the seat in the fully covered position.

Referring to the embodiment of FIGS. 9 through 11, a shock-absorber 157 in the form of an air bag 66 is provided beneath an upper portion 53c of the cover member 53b of the casing 53. The air bag 66 is made of synthetic resin and is formed into a bellows configuration. An annular periphery of an upper end portion of the air bag 66 is connected in a fluid tight manner to the upper portion 53c of the cover member 53b via sealing member 68. A lower end portion of the air bag 66 is provided at a central portion thereof with a downward projection 66d having an air passage 66a extending therethrough. Another air passage 66b in the form of an orifice is formed in the lower end portion of the air big 66. The inside 66c of the air bag 66 is in fluid communication with the outside thereof through the air passages 66b and 66a while the air bag 66 is in fully expanded oondition as shown in FIG. 9. A lever 65 is fixedly connected to the seat 52 via pin 54 so as to be movable together with the seat 52. The lever 65 is provided at a distal end portion thereof with a convex portion in which a resilient member 67 is set. A lid 70 is rotatably mounted on the pin 54 so as to be movable relative to the seat 52. In FIG. 9, after $\gamma$ degrees rotation of the seat 52 in the counter-clockwise direction from a rest position illustrated in solid lines to a position illustrated in phantom lines, the resilient member 67 is brought into engagement with the projection 66d of the air bag 66 whereby the air passage 66a is closed. In accordance with further counter-clockwise rotation of the seat 52 and the lever 65, air in the air bag 66 is gradually discharged from the orifice 66b. Since the resulting air-discharge provides a shock-absorbing operation, upon engagement of the seat 52 with tne upper side 51b of the toilet bowl 51 (FIG. 10), no hard collision therebetween occurs. As apparent from FIG. 11, during raising movement of the seat 52, air is being introduced into the air bag 66 due to expansion thereof. As seen from FIG. 12, for assisting such expansion of the air bag 66, a spring 71 may be available. A check valve 72 is also available, so as to prevent introduction of air into the bag 66 during downward movement of the seat 52 and permit the introduction of air into the bag upon upward movement of the seat.

Figure 14:
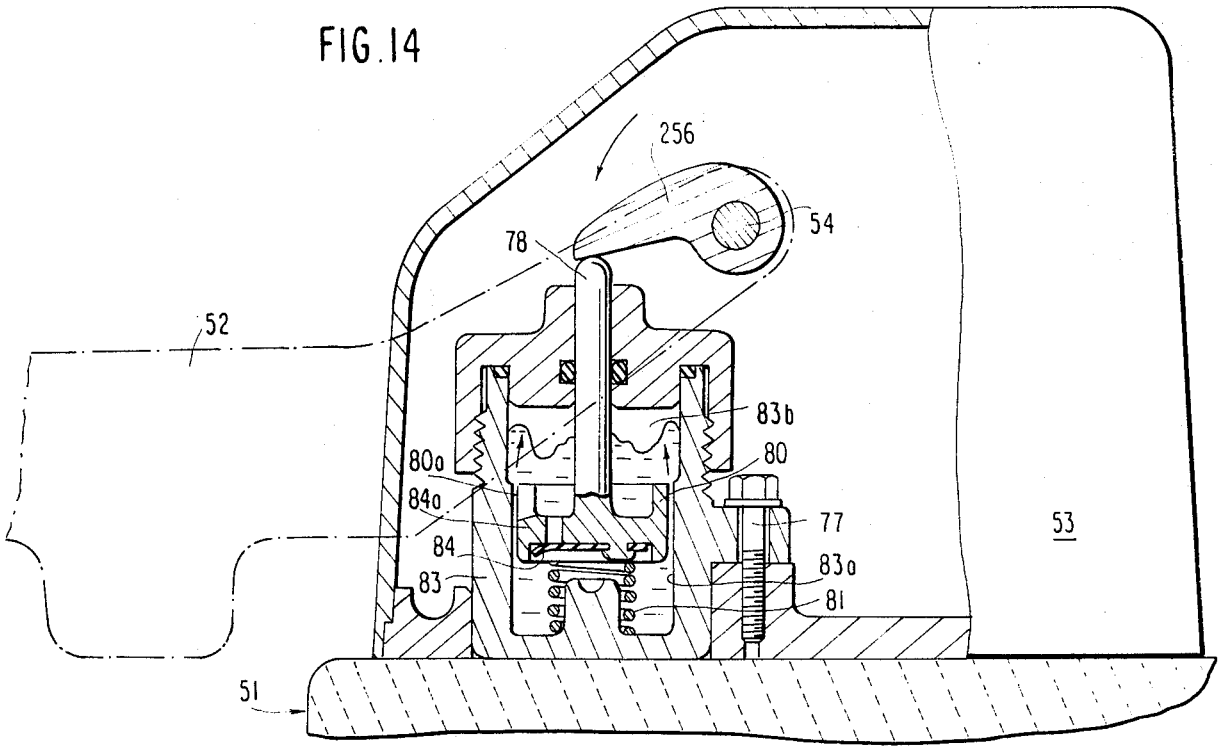
FIG. 14 is a view similar to FIG. 13 illustrating the seat in the fully covered position.
Figure 15:
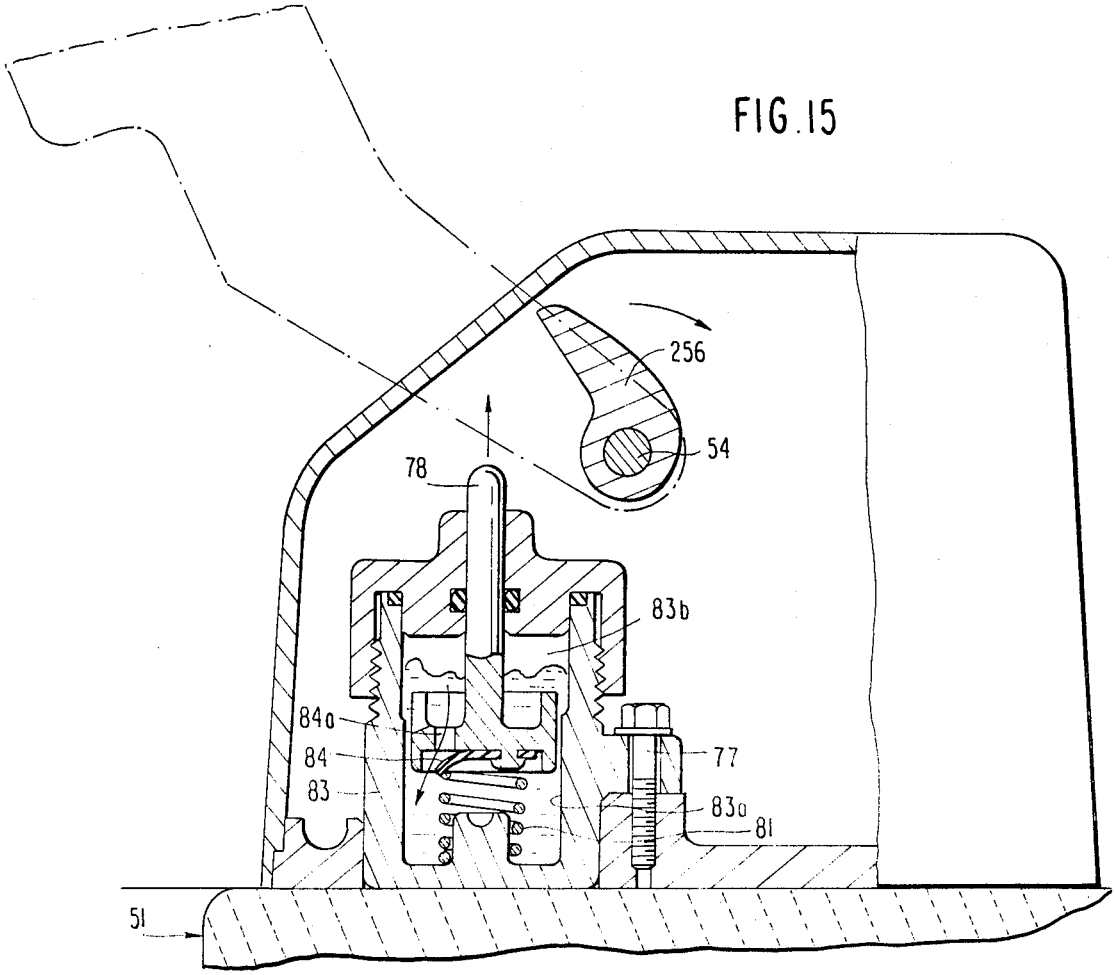
FIG. 15 is a view similar to FIG. 14 showing the seat in the partially raised position.

In FIGS. 13 through 15, an oil-damper 76 acting as a shock-absorber is fixed to the base plate 53a of the casing by a bolt 77. As is well-known, the oil-damper 76 has a rod 78 for receiving a downwardly directed force as the seat is covered. When a lever 256, movable together with the seat 52, is brought into engagement with the rod 78 after $\alpha$ degrees of movement of the seat 52 in the counter-clockwise direction, a piston 80 secured to the rod 78 is moved in the downward direction against a spring 81. During downward movement of the piston 80 as a result of rotation of the seat 52 beyond the angle $\beta$, fluid 82 in a lower chamber 83a of a body 83 is forced into an upper chamber 83b through an annular clearance 80a defined between the piston 80 and the body 83 (FIG. 14). Upon disengagement of the rod 78 with the lever 256 due to clockwise rotation of the seat 52, the piston 80 is moved in the upward direction so as to be returned to its original position due to expansion of the spring 81. During upward movement of the piston 80, fluid in the upper chamber 83b is supplied to the lower chamber 83a through a check-valve 84 which controls the passage 84a (FIG. 15).

Figure 16:
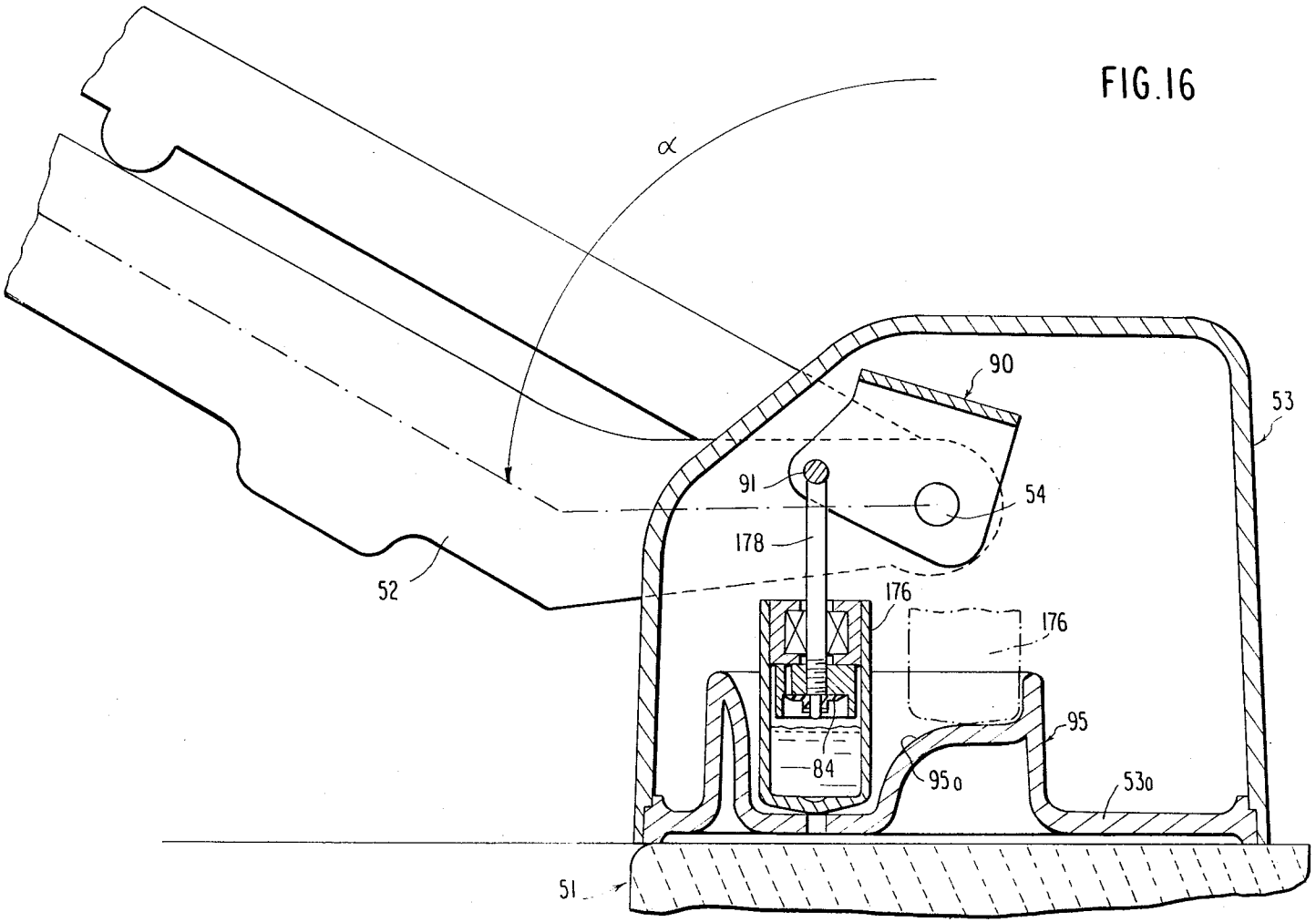
FIG. 16 is a cross-sectional view of a rear portion of a sanitary device according to a sixth embodiment of the present invention.

In FIGS. 16 through 18, a bracket 90 is fixed to the pin 54 so as to be movable together with the seat 52. The bracket 90 has a pair of spaced walls 90a, 90a. Opposite end portions of the shaft 91 are rotatably supported by the walls 90a, 90a, respectively. A rod 178 of an oil-damper 176 is connected to the middle portion of the shaft 91 and depends therefrom. During $\alpha$ degrees rotation of the seat 52, the oil-damper 176 is transferred from a rest position illustrated in phantom lines to a position illustrated in solid lines along a curved surface 95a of a guide member 95 on the base plate 53a. In accordance with further rotation of the seat 52, the oil-damper 176 acts as a shock-absorber.

While the invention has been particularly shown and described with reference to preferred embodiments thereof, it will be understood by those in the art that the foregoing and other changes in form and details may be made therein without departing from the spirit and scope of the invention.

What is claimed is:

1. A sanitary device comprising:

a toilet bowl;

a seat pivotably mounted on a rear end portion of said toilet bowl;

shock-absorber means mounted on said rear end portion of said bowl for preventing a hard collision of said seat on an upper side of said toilet bowl; and operating means connected to said seat for rotation therewith whereby upon lowering said seat, said operating means is brought into operative engagement with said shock-absorber means when the inclination of said seat relative to said upper side of said toilet bowl becomes less than a set value.

2. A sanitary device in accordance with claim 1, wherein said operating means includes a sector and said shock-absorber includes a stationary member provided on said rear end portion, a rotating member rotatably mounted on said stationary member, a clearance defined between said stationary member and said rotating member, and a viscous fluid disposed in said clearance so as to generate a shearing force between said stationary member and said rotating member upon rotation thereof; said sector being in engagement with said rotating member so long as said inclination of said seat relative to said upper side of said toilet bowl is less than said set value.

3. A sanitary device in accordance with claim 2, wherein said engagement between said sector member and said rotating member is a gear meshing engagement.

4. A sanitary device in accordance with claim 2, wherein said engagement between said sector member and said rotating member is a frictional engagement.

5. A sanitary device in accordance with claim 4, wherein a resilient member is provided on at least one of said sector member and said rotating member.

6. A sanitary device in accordance with claim 2, wherein a one-way clutch is provided between said stationary member and said rotating member.

7. A sanitary device in accordance with claim 1, wherein said operating means includes a lever movable together with said seat, and said shock-absorber means includes an air bag in the form of bellows having an end portion with air passage through which air is discharged during engagement between said lever and said side portion due to downward movement of said seat.

8. A sanitary device in accordance with claim 7, wherein an expanding spring is disposed in said air bag.

9. A sanitary device in accordance with claim 1, wherein said operating means includes a lever movable together with said seat, and said shock-absorber is an oil-damper having a rod for receiving a force to be reduced, said lever being in engagement with said rod so long as said inclination of said seat relative to said upper side of said toilet bowl is less than said set value.

10. A sanitary device in accordance with claim 1, wherein said shock-absorber means is an oil-damper having a rod for receiving a force to be reduced and a casing in which a piston integrally formed with said rod is slidably fitted, said rod being pivoted to and depended from a bracket movable together with said seat, and guide means for movably supporting said casing of said oil damper during initial downward movement of said seat with said oil-damper being at rest on said rear end portion so long as said inclination of said seat relative to said upper side of said toilet bowl is less than set value.

* * * * *